United States Patent [19]

Bush

[11] 4,333,589

[45] Jun. 8, 1982

[54] CHILD-RESISTANT OVERCAP FOR A PRESSURIZED CONTAINER

[75] Inventor: Randall G. Bush, Evansville, Ind.

[73] Assignee: Sunbeam Plastics Corporation, Evansville, Ind.

[21] Appl. No.: 163,939

[22] Filed: Jun. 30, 1980

[51] Int. Cl.[3] ..... B67D 5/32; B65D 83/14; B65D 51/20

[52] U.S. Cl. ..... 222/402.11; 222/402.13

[58] Field of Search ..... 222/153, 182, 402.11, 222/402.13

[56] References Cited

U.S. PATENT DOCUMENTS

| | | | |
|---|---|---|---|
| 3,642,179 | 2/1972 | Micallef | 222/402.11 X |
| 3,734,353 | 5/1973 | McIlhenny | 222/153 |
| 3,749,286 | 7/1973 | Douglas | 222/402.13 X |
| 3,828,982 | 8/1974 | Steigerwald | 222/153 |
| 3,837,537 | 9/1974 | Baldwin | 222/402.11 X |
| 4,171,758 | 10/1979 | Corba | 222/402.13 X |

FOREIGN PATENT DOCUMENTS

| | | | |
|---|---|---|---|
| 2271995 | 12/1975 | France | 222/402.13 |
| 2310284 | 12/1976 | France | 222/402.13 |

*Primary Examiner*—David A. Scherbel

*Attorney, Agent, or Firm*—Fisher, Gerhardt, Crampton & Groh

[57] ABSTRACT

A child-resistant overcap for a pressurized container, such as an aerosol can, having a valve with an axially protruding discharge nozzle which must be depressed to actuate the valve for discharging the contents of the container. The overcap includes a valve guard moveable between an outer position in which a portion of the guard overlies the nozzle for preventing actuation thereof and an inner position in which the nozzle can be depressed. The overcap includes a resilient portion of the guard which biases the guard toward outer position and which must be overcome in order to move the guard to inner position and which returns the guard to outer position when the guard is released.

7 Claims, 8 Drawing Figures

FIG. 1
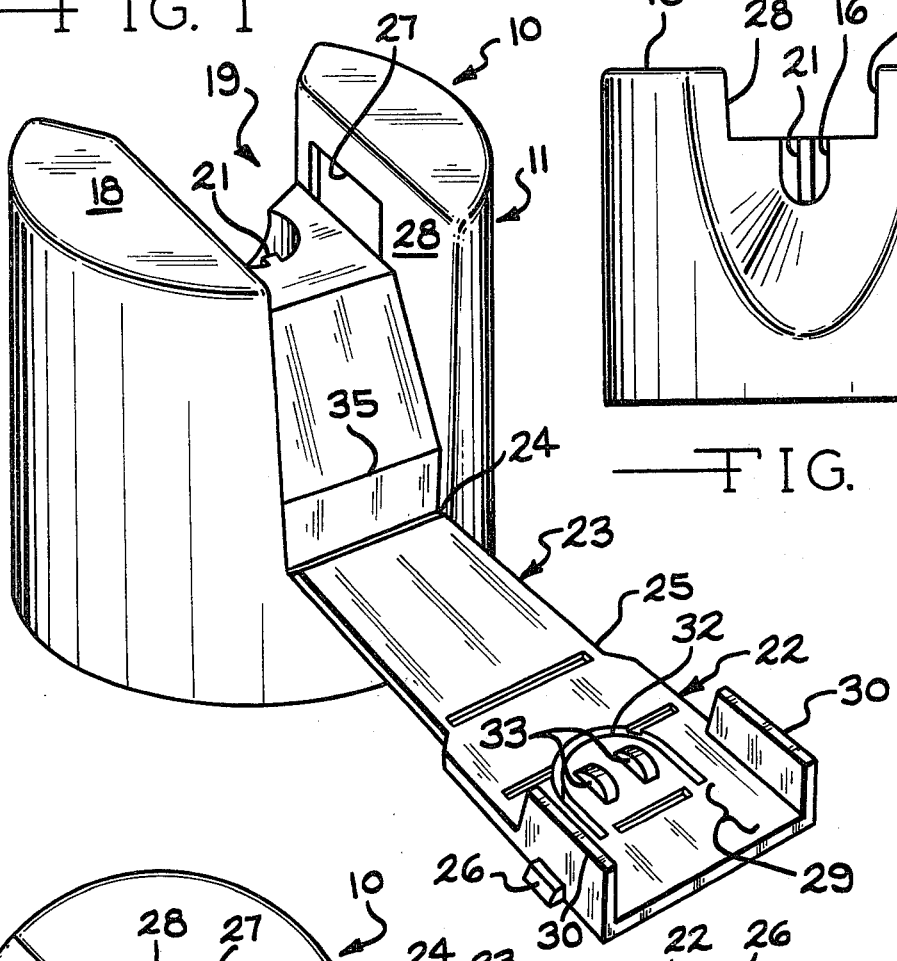
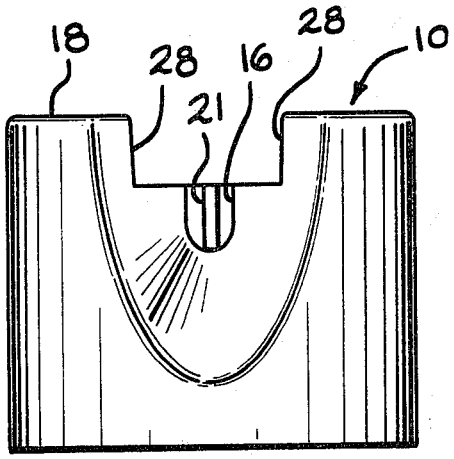
FIG. 4
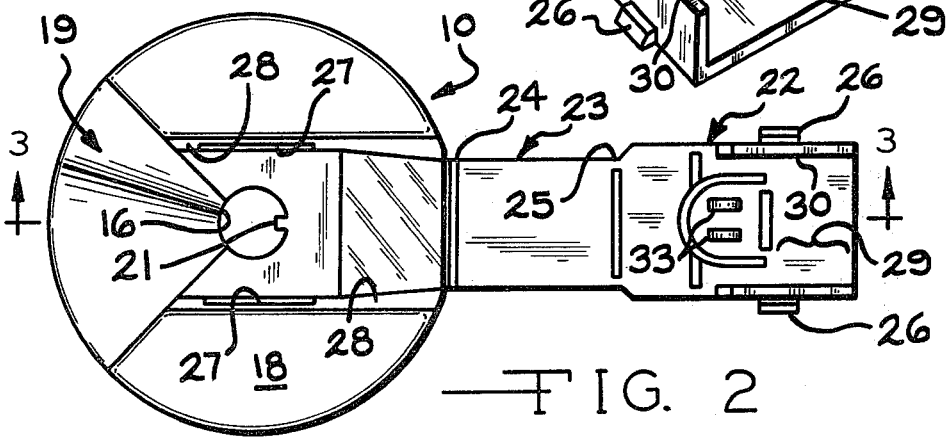
FIG. 2
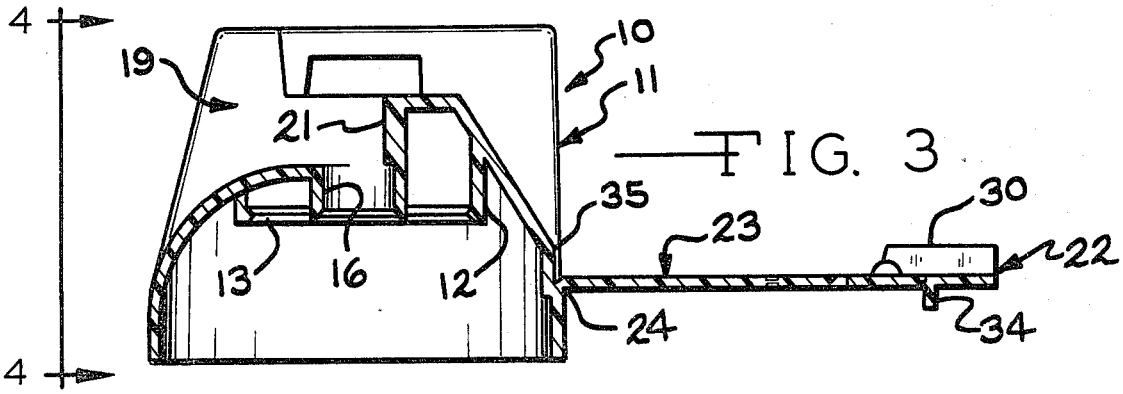
FIG. 3

FIG. 5
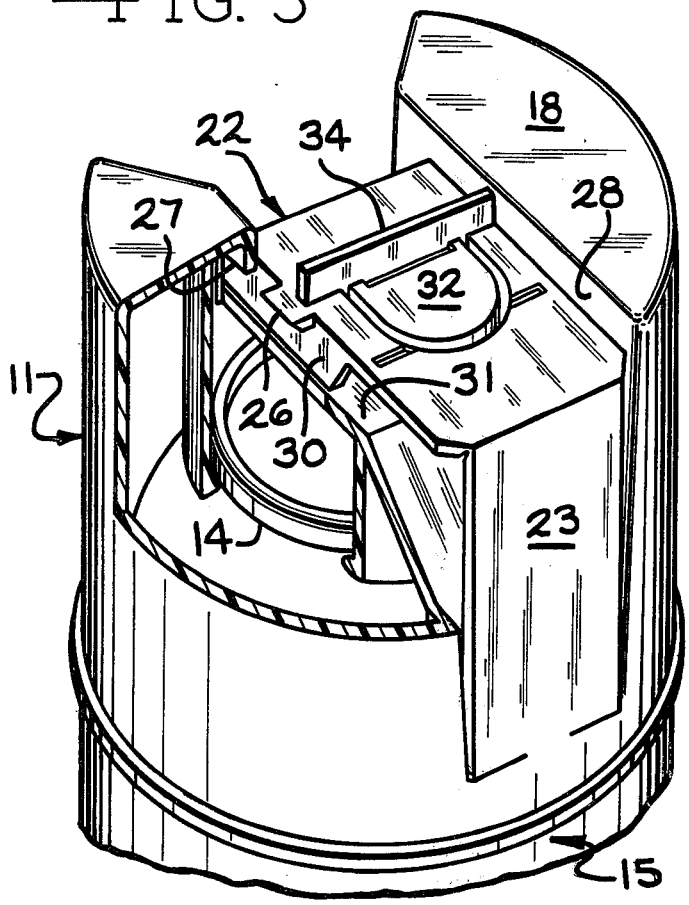
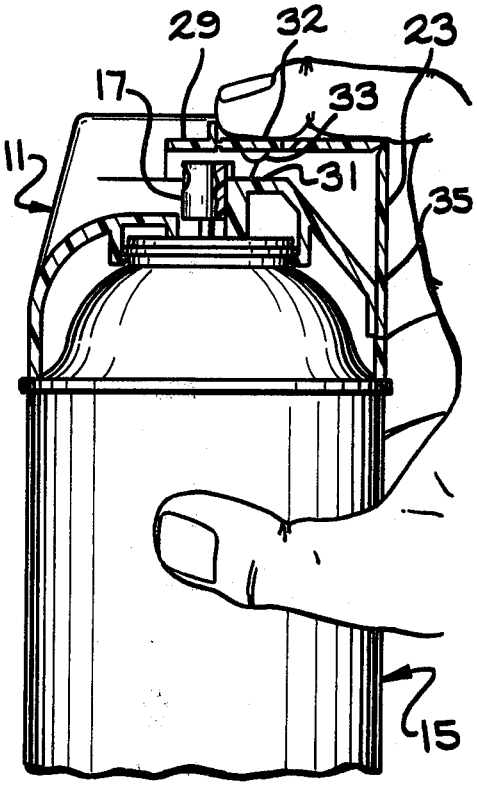
FIG. 7
FIG. 6
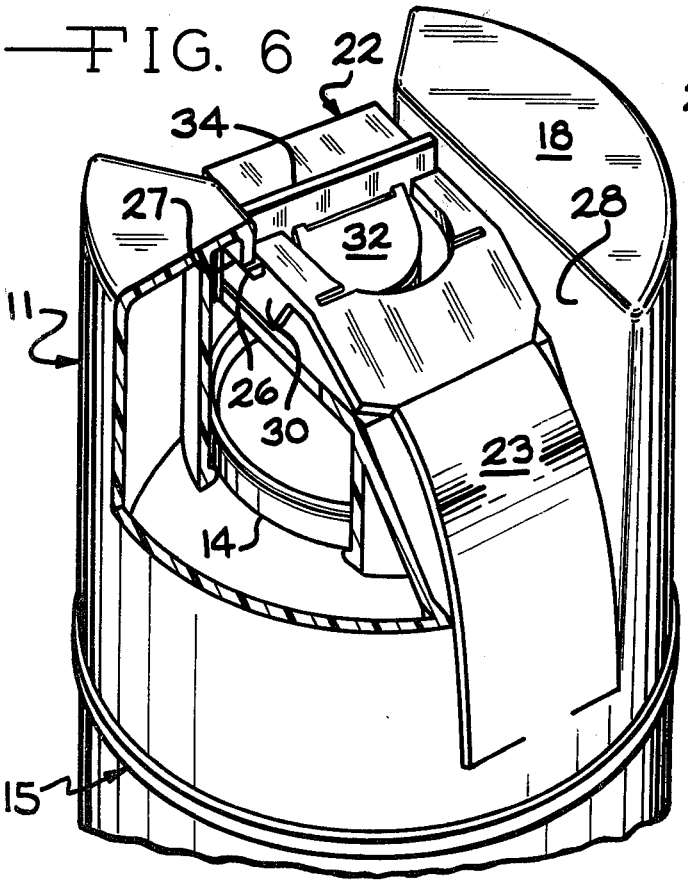
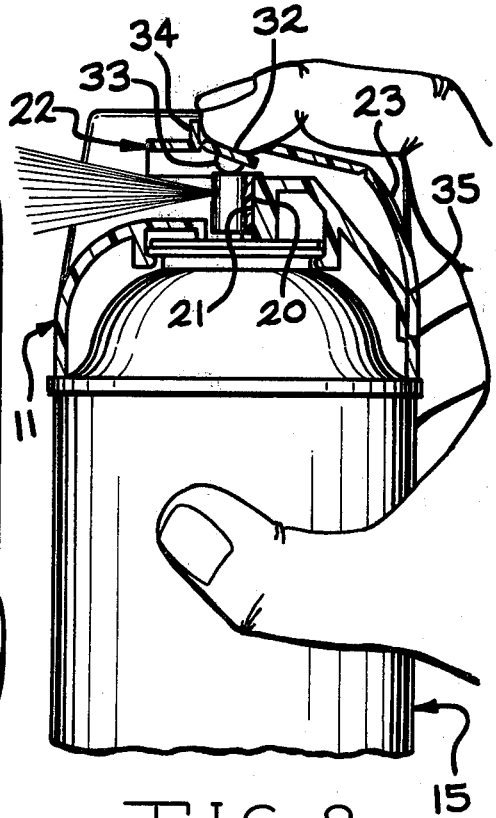
FIG. 8

CHILD-RESISTANT OVERCAP FOR A PRESSURIZED CONTAINER

BACKGROUND OF THE INVENTION

Because so many products commonly used in households, such as paints, insect sprays, deodorants, room fresheners, etc., are packaged in pressurized containers having readily actuatable dispensing valves, it is important that containers of this type be provided with means for rendering them child-resistant.

It has been customary for many years to equip pressurized containers of this type with what are called "overcaps" many of them having central finger depressions which guide a user's finger to a position for depressing the centrally located valve-actuating and spray directing nozzle to discharge the contents from the can. Therefore, many of the suggested child-resistant overcaps have generally followed this same construction with added elements to provide the child-resistant feature.

Most of the child-resistant overcaps, for example the cap disclosed in Corba U.S. Pat. No. 4,171,758 require what Corba calls ". . . a conscious action to return the actuator to a child-safe condition".

A number of other overcaps for containers of this type have included members which obstruct access to the valve-actuating nozzle except by fingers of length or width greater than those usually possessed by a small child of tender years, say, five or six. It is apparent, however, that some of these actuators could not be utilized by even an adult or an older child who had small hands with short or narrow fingers.

It is, therefore, the principal object of the instant invention to provide a child-resistant overcap for a pressurized container comprising a valve guard which is movable between valve-guarding position and valve-actuating position and which includes resilient means biasing the valve guard toward guarding position whereby, after movement to valve-actuating position by an adult or older child, the valve guard automatically is restored to valve-guarding or child-resistant position without the necessity for a conscious action on the part of the user.

It is yet another object of the instant invention to provide an overcap for a pressurized container having a centrally located and upwardly extending valve nozzle which comprises a valve guard that is radially movable between an outer, valve-guarding or child-resistant position and an inner valve-actuating position, and an integral resilient means which biases the valve guard toward the outer valve-guarding or child-resistant position.

And yet another object of the instant invention is to provide such a child-resistant overcap for a pressurized container having a central, upwardly protruding valve nozzle which comprises a valve guard and resilient means all of which are integral with the overcap structure.

BRIEF DESCRIPTION OF THE DRAWINGS

FIG. 1 is a view in perspective of an overcap embodying the invention with its parts shown in the position in which they initially are molded;

FIG. 2 is a top plan view of the overcap embodying the invention as illustrated in FIG. 1 and shown on a smaller scale;

FIG. 3 is a vertical sectional view taken along the line 3—3 of FIG. 2;

FIG. 4 is a front view in elevation taken from the position indicated by the line 4—4 of FIG. 3;

FIG. 5 is a view in perspective, with parts broken away, showing an overcap embodying the invention in position on a pressurized container which is fragmentarily shown, with its valve guard elements in valve-guarding position;

FIG. 6 is a view, similar to FIG. 5, but showing the valve guard in its valve-actuating position;

FIG. 7 is a diametric, vertical sectional view of an overcap embodying the invention in place on a pressurized container, the overcap and its valve guard being illustrated in the valve-guarding position as also is shown in FIG. 5; and FIG. 8 is a view similar to FIG. 7 but showing the overcap of the invention with its valve guard in valve-actuating position as also is shown in FIG. 6.

DESCRIPTION OF PREFERRED EMBODIMENT

An overcap embodying the invention, indicated by the reference number 10 has a generally cup-shaped body 11, the body 11 having an inner annular skirt 12 at the margin of which there is an inwardly extending lip 13. The lip 13 is of such size as to snap over a conventional valve assembly retaining seam 14 (see FIGS. 5–8, inclusive), of a conventional pressurized container 15. The overcap body 11 has a central vertical bore 16 which is of such size as to fit around a conventional valve discharge nozzle 17. The overcap body 11 has a configuration which provides a closed top 18 and inner walls defining a finger depression 19 which extends diametrically across the overcap 10 and intersects the nozzle bore 16 so that, when the overcap 10 is in position on the container 15 the nozzle 17 protrudes upwardly into the depression 19. The nozzle 17 has a vertical key way 20 in which a key 21 at the side of the nozzle bore 16 engages to orient the nozzle 17 in the finger depression 19 so that the spray of contents is properly directed as shown in FIG. 8.

An overcap embodying the invention comprises a combination of the foregoing structural elements which are known in the art with additional elements by which the overcap of the invention is rendered child-resistant in its normal condition, which readily can be actuated by an adult or an older child to provide for actuation of the valve and discharge of the contents of the container and which automatically restores itself to child-resistant condition immediately upon disengagement or release by a user.

The overcap 10 of the invention includes a valve guard 22 integrally molded with a resilient web 23 and integrally connected by the web 23 to the overcap body 11 by a hinge portion 24. The hinge portion 24 extends generally tangentially to the body 11 at a level beneath that of the finger depression 19. A second hinge portion 25 is also formed at the time of initial molding at the junction between the guard 22 and the resilient web 23.

Because the entire overcap 10 consisting of the body 11, guard 22 and web 23 is integral when molded from a suitable tough resistant material, such as polypropylene resin, the fact that the web 23 and guard 22 extend horizontally from the body 11 when initially molded results in those parts wishing to return to that position relative to the body 11. As a result, when the guard 22 and resilient web 23 are swung upwardly and to the left (in a counter-clockwise direction) from the position shown in FIG. 3, the resilient web 23 biases the guard 22 to return to the position shown in FIG. 3.

However, the guard 22 has a pair of laterally extending tabs 26 which snap into recessed guide ways 27 formed in inner walls 28 which define the sides of the finger depression 19. The engagement of the tabs 26 in the guide ways 27 serves not only to retain the guard in its operating position, as illustrated in FIGS. 5–8, inclusive, but it also functions to guide the guard in its movement radially between the valve-guarding position of FIGS. 5 and 7 and the valve-actuating position of FIGS. 6 and 8.

The guard 22 has a portion at its free end, indicated by the bracket 29, which is the innermost portion of the guard 22 after the guard has been swung up and over into its operative location in the finger depression 19. As best can be seen in FIG. 7, this innermost portion 29 of the guard 22 overlies the valve nozzle 17 when the valve guard is in its outer position. In this position of the guard 22 its side rails 30 slide on a flat portion 31 of the bottom of the finger depression 19. As a result downward movement of the innermost portion 29 of the guard 22 is prevented when the guard 22 is in the position shown in FIGS. 5 and 7.

The guard 22 also has a generally semi-circular depressable portion 32 forming a valve actuator. The valve actuator 32 is depressable in all positions of the guard 22 and it overlies the top of the nozzle 17 to engage it when the guard 22 is in valve-actuating position as illustrated in FIGS. 6 and 8. A pair of ears 33 are molded on the underside of the depressable portion 32 so that when the portion 32 is pressed downwardly by the finger of the user, as shown in FIG. 8, the ears 33 engage the top of the nozzle 17 to actuate the valve for the discharge of material.

In order that a user may move the guard 22 from the position shown in FIGS. 5 and 7 to the valve-actuating position shown in FIGS. 6 and 8, the guard 22 also has an element 34 which extends upwardly when the guard is in operating position and is engageable by the end of a finger of a user in order that the user may slide the guard from the valve-guarding position of FIGS. 5 and 7 to the valve-actuating position of FIGS. 6 and 8.

It will be observed by comparing FIGS. 5 and 7 with FIGS. 6 and 8, respectively, that when the guard 22 is moved into valve-actuating position, the resilient web 23 is flexed inwardly over a sharp edge 35 of a part of the bottom of the finger depression 19.

When the user releases the guard 22 by withdrawing his finger from the position illustrated in FIG. 8, the flexure of the resilient web 23 seeking to return to the position illustrated in FIGS. 5 and 7 and its "memory" tending to return it to its initially molded position as shown in FIGS. 1–3, inclusive, causes the guard 22 to be immediately moved outwardly to valve-guarding position thus restoring the overcap to its child-resistant condition.

Having described my invention, I claim:

1. A child-resistant overcap for a pressurized container which includes a dispensing valve at the center top thereof, said container also having an annular assembly seam surrounding said valve and a tubular nozzle axially moveable to actuate said valve, said overcap comprising, in combination, (a) a generally cup-shaped body having (1) a depending skirt with a lip at its lower margin that is adapted to engage said seam for retaining said overcap on said container, (2) an axial opening that is adapted to receive said axially moveable nozzle and (3) a top having a finger depression extending across said top and intersecting said axial opening, (b) a valve guard unitary with said body and mountable in the finger depression for movement between a valve-guarding position and a valve-actuating position said valve guard including a valve actuator movable relative to said valve guard in all of its positions and being movable into actuating engagement with said nozzle only when said valve guard is in said valve actuating position, (c) co-operating means on said guard and said body for guiding said guard between such positions, and (d) resilient means formed integrally with said body and guard and biasing said guard toward such guarding position.

2. A child-resistant overcap according to claim 1 in which the valve guard is movable radially relative to said nozzle.

3. A child-resistant overcap according to claim 2 in which the valve guard is movable between an outer valve-guarding position and an inner valve-actuating position.

4. A child-resistant overcap according to claim 3 and an element on that end of the guard which is innermost when said guard is in outer valve-guarding position, said element being engageable by the finger of a user for moving said guard inwardly to valve-actuating position.

5. A child resistant overcap according to claim 3 wherein said valve actuator is a flexible portion in the guard which overlies the top of the nozzle when said guard is in its inner valve-actuating position.

6. A child-resistant overcap according to claim 1 in which the guide means for the guard consists of ways in the walls of the body which walls define the sides of the finger depression and tabs on the sides of said guard which are engaged in said ways.

7. In a child-resistant overcap for a pressurized container having an axially extending valve and valve nozzle, said overcap having an inverted generally cup-shaped body which has spaced, inner walls defining therebetween a diametrically extending finger depression and which has a central bore through which said nozzle protrudes into said finger depression when said overcap is in position on said container, the improvement comprising:

(a) a valve guard movable horizontally in said finger depression between an outer valve-guarding position and an inner valve-actuating position, (b) recessed, horizontal guideways for said guard in the walls of said body which define said finger depression, (c) laterally extending tabs on said guard which are adapted to fit into said guideways, and (d) a resilient web that is integrally connected to the outer end of said guard and to the outer side of said body at a point below the level of said finger depression and which biases said guard toward outer position, said guard having an innermost portion which overlies and prevents depression of said nozzle when said guard is in outer position, a depressable portion intermediate its inner and outer ends which overlies said nozzle when said guard is in its inner position, and an element at the inner side of said depressable portion which is engageable by the finger of a user for moving said guard to its inner position, whereby when said guard is released in its inner position said resilient web returns said guard to its outer valve-guarding position.

* * * * *

UNITED STATES PATENT AND TRADEMARK OFFICE

CERTIFICATE OF CORRECTION

PATENT NO. : 4,333,589

DATED : June 8, 1982

INVENTOR(S) : Randall G. Bush

It is certified that error appears in the above—identified patent and that said Letters Patent is hereby corrected as shown below:

Column 2, line 62, "resistant" should read --resilient--

Signed and Sealed this

*Sixteenth* Day of *November 1982*

[SEAL]

*Attest:*

GERALD J. MOSSINGHOFF

*Attesting Officer*

*Commissioner of Patents and Trademarks*